US005260712A

United States Patent [19]

Engheta et al.

[11] Patent Number: 5,260,712

[45] Date of Patent: Nov. 9, 1993

[54] PRINTED-CIRCUIT ANTENNAS USING CHIRAL MATERIALS

[75] Inventors: Nader Engheta, King of Prussia; Dwight L. Jaggard, Newtown Square, both of Pa.

[73] Assignee: The Trustees of the University of Pennsylvania, Philadelphia, Pa.

[21] Appl. No.: 871,580

[22] Filed: Apr. 20, 1992

Related U.S. Application Data

[63] Continuation of Ser. No. 376,071, Jun. 6, 1989, abandoned.

[51] Int. Cl.[5] ..... H01Q 1/380; H01Q 15/240; H01Q 25/000

[52] U.S. Cl. ..... 343/700 MS; 343/756

[58] Field of Search ..... 343/700 MS, 756, 829, 343/846, 795, 909

[56] References Cited

U.S. PATENT DOCUMENTS

| | | | |
|---|---|---|---|
| 2,841,786 | 7/1958 | Dicke | 343/872 |
| 3,951,904 | 4/1976 | Tomonaga | 260/40 R |
| 3,972,049 | 7/1975 | Kaloi | 343/700 MS |
| 4,452,727 | 6/1984 | Frommer et al. | 252/518 |
| 4,456,548 | 6/1984 | Lewis et al. | 252/500 |
| 4,475,107 | 10/1984 | Makimoto et al. | 343/700 MS |
| 4,616,067 | 10/1986 | Lee et al. | 525/192 |
| 4,678,616 | 7/1987 | Tzeng | 428/551 |
| 4,772,890 | 9/1988 | Bowen et al. | 343/756 |
| 4,809,011 | 2/1989 | Kunz | 343/787 |
| 4,948,922 | 8/1990 | Varadan et al. | 174/35 GC |

OTHER PUBLICATIONS

Lakhtakia et al. Radiation by a Straight Thin-Wire Antenna Embedded in an Isotropic Medium, IEEE Trans. on Electromagnetic Compatibility, vol. 30, No. 1, Feb., 1988.

R. B. Kaner et al., "Plastics That Conduct Electricity," *Scientific American* (Feb. 1988).

A. Lakhtakia et al., "Scattering and Absorption Characteristics of Lossy Dielectric, Chiral, Non-Spherical Objects," *Applied Optics*, vol. 24, No. 23 (Dec. 1, 1985).

A. Lakhtakia et al., "A Parametric Study of Microwave Reflection Characteristics of a Planar Achiral-Chiral Interface," *IEEE Transactions on Electromagnetic Compatibility*, vol. EMC-28, No. 2 (May 1986).

Varadan et al., "On the Possibility of Designing Antireflection Coatings Using Chiral Composites," *Journal of Wave Material Interaction*, vol. 2, No. 1 (Jan. 1987), pp. 71-81.

D. L. Jaggard et al., *Applied Physics*, 18, 1979, pp. 211-215.

S. Bassiri et al, *Alta Frequenza*, 2, 1986, pp. 83-88.

N. Engheta et al., *IEEE Trans. on Ant. & Propag.*, 37, 4, 1989, pp. 512-515.

S. Bassiri et al., *J. Opt. Soc. Am.* A5, 1988, pp. 1450-1459.

N. Engheta and P. Pelet, *Opt. Lett.*, 14, 1989, pp. 593-595.

*Primary Examiner*—Rolf Hille
*Assistant Examiner*—Peter Toby Brown
*Attorney, Agent, or Firm*—Synnestvedt & Lechner

[57] ABSTRACT

Printed-circuit antennas comprising chiral materials. Printed-circuit antennas in accordance with this invention comprise chiral materials wherein two electromagnetic modes are allowed. The printed-circuit antennas are particularly useful for aircraft antennas, communication antennas and smart skins.

3 Claims, 2 Drawing Sheets

PRINTED-CIRCUIT ANTENNAS USING CHIRAL MATERIALS

This is a continuation, of application Ser. No. 376,071, filed Jun. 6, 1989 which is now abandoned.

FIELD OF INVENTION

Generally this invention relates to printed-circuit antennas. More specifically, this invention relates to printed-circuit antennas comprising chiral materials.

BACKGROUND OF THE INVENTION

It has been shown that, for time-harmonic electromagnetic fields with $\exp(-i\omega t)$ excitation, a homogeneous, low loss, isotropic chiral (optically active) medium can be described electromagnetically by the following constitutive relations:

$$D=\epsilon E+i\xi_c B \quad (1)$$

$$H=i\xi_c E+(1/\mu)B \quad (2)$$

where E, B, D and H are electromagnetic field vectors and $\epsilon$, $\mu$, $\xi_c$ represent the dielectric constant, permeability and chirality admittance of the chiral medium, respectively. A "chiral medium" comprises chiral objects of the same handedness, randomly oriented and uniformly distributed. A chiral object is a three-dimensional body that cannot be brought into congruence with its mirror image by translation and rotation. Therefore, all chiral objects can be classified in terms of their "handedness." The term "handedness," as known by those with skill in the art, refers to whether a chiral object is "right-handed" or "left-handed." That is, if a chiral object is right-handed (left-handed), its mirror image is left-handed (right-handed). Therefore, the mirror image of a chiral object is its enantiomorph.

Chiral media exhibit electromagnetic chirality which embraces optical activity and circular dichroism. Optical activity refers to the rotation of the plane of polarization of optical waves by a medium while circular dichroism indicates a change in the polarization ellipticity of optical waves by a medium. There exists a variety of materials that exhibit optical activity. For example, for 0.63-μm wavelength, $TeO_2$ exhibits optical activity with a chirality admittance magnitude of $3.83\times10^{-7}$ mho. This results in a rotation of the plane of polarization of 87° per mm. These phenomena, known since the mid nineteenth century, are due to the presence of the two unequal characteristic wavenumbers corresponding to two circularly polarized eigenmodes with opposite handedness. The fundamentals of electromagnetic chirality are known. See, e.g., J. A. Kong, Theory of Electromagnetic Waves, pages 2–8, 77–79 (1975); E. J. Post, *Formal Structure of Electromagnetics*, pages 127–137, 171–176 (1962). More recent work includes the macroscopic treatment of electromagnetic waves with chiral structures, D. L. Jaggard et al., "On Electromagnetic Waves in Chiral Media", *Applied Physics*, 18, 211, (1979); the analysis of dyadic Green's functions and dipole radiation in chiral media, S. Bassiri et al. "Dyadic Green's Function and Dipole Radiation in Chiral Media", *Alta Frequenza*, 2, 83, (1986) and N. Engheta et al. "One- and Two-Dimensional Dyadic Green's Functions in Chiral Media", *IEEE Trans. on Ant. & Propag.*, 37, 4, (1989); the reflection and refraction of waves at a dielectric-chiral interface, S. Bassiri et al., "Electromagnetic Wave Propagation Through a Dielectric Chiral Interface and Through a Chiral Slab", *J. Opt. Soc. Am.* A5, 1450, (1988); and guided-wave structures comprising chiral materials, N. Engheta and P. Pelet, "Modes in Chirowaveguides", *Opt. Lett.*, 14, 593, (1989).

SUMMARY OF THE INVENTION

In accordance with this invention, printed-circuit antennas comprising at least one antenna element, and chiral media wherein two electromagnetic modes are allowed, are provided.

DETAILED DESCRIPTION OF PREFERRED EMBODIMENTS

The inventors of the subject matter disclosed and claimed herein have achieved novel results in the theoretical investigation of printed-circuit antennas comprising chiral materials. The terms "chirostrip antennas", and "antennas" are used interchangeably throughout the present disclosure to denote printed-circuit antennas provided in accordance with the present invention. As known by those with skill in the art, an "antenna" is a structure which can transmit or receive electromagnetic energy. Chirostrip antennas have a variety of potential applications including, but not limited to, remote sensing, electronic surveillance systems, automatic landing of aircrafts, telecommunications systems, and smart skins.

Figure 1:
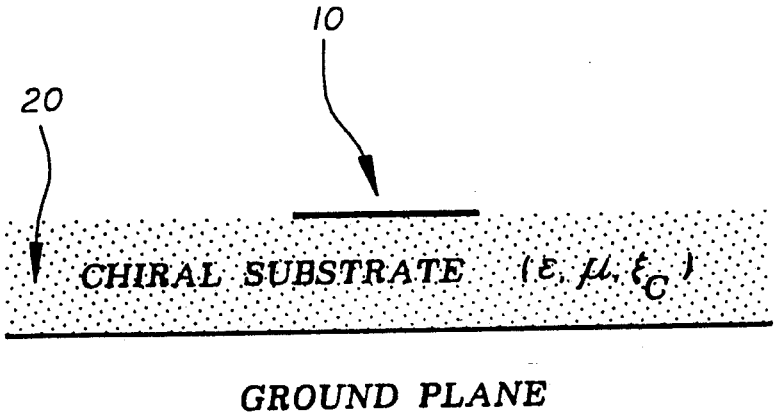
FIG. 1 is a printed-circuit antenna provided in accordance with this invention comprising a chiral material.

Referring now to the drawings wherein like reference numbers refer to like elements, FIG. 1 shows a preferred embodiment of a chirostrip antenna provided in accordance with this invention. Preferably, a metallic patch 10 is an "antenna element" and is printed on top of substrate 20 comprising a chiral material. As used throughout, the term "antenna element" is a typical conducting structure such as, for example, dipoles, patches, apertures, loops, turnstyles, and the like. Antenna elements may be printed on chiral medium by standard printing techniques.

Using the constitutive relations (1) and (2), and the Maxwell equations with electric current source, the following Helmholtz equations for the electric field inside and outside the substrate are obtained;

$$\nabla\times\nabla\times E-2\omega\mu\xi_c\nabla\times E-k^2E=i\omega\mu J \text{ inside the substrate 20} \quad (3)$$

and $$\nabla\times\nabla\times E-k_0^2E=i\omega\mu J \text{ outside the substrate 20.} \quad (4)$$

In Eqs. (3) and (4), E is the electric field vector, $\omega$ is the radian frequency of the time harmonic fields, $k=\omega\sqrt{\mu\epsilon}$, $k_0=\omega\sqrt{\mu_0\epsilon_0}$, where $\epsilon_0$ and $\mu_0$ are the permittivity and the permeability of free space, respectively, and J is the electric current source. For a plane wave propagation in an unbounded chiral medium, there exist two eigenmodes of propagation, a right- and a left-circularly polarized (RCP and LCP) plane wave with wavenumbers $$k_{\pm} = \pm\omega\mu\xi_c + \sqrt{k^2 (\omega\mu\xi_c)^2} \ . \tag{5}$$

Figure 2:
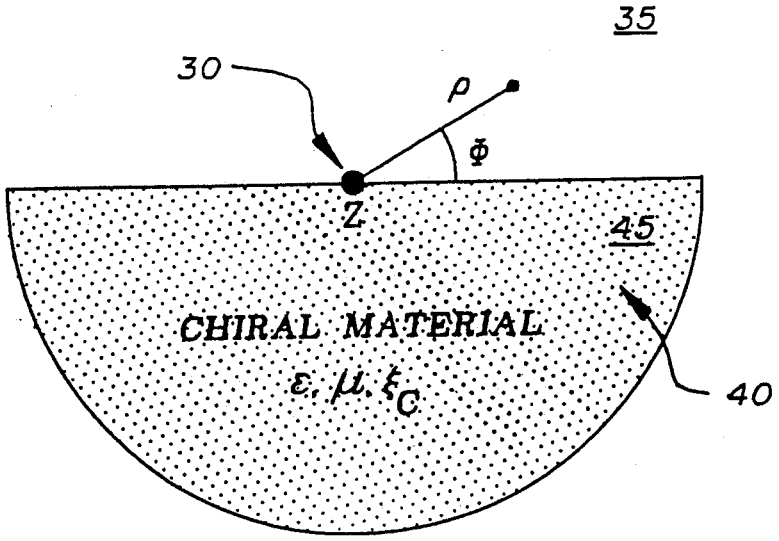
FIG. 2 is a preferred embodiment of a chirostrip antenna provided in accordance with this invention comprising a thick semicylindrical chiral substrate.

Referring to FIG. 2, a preferred embodiment of a chirostrip antenna provided in accordance with this invention is shown. This antenna comprises a long wire 30 as an antenna element printed on top of a thick semi-cylindrical substrate of a homogeneous, isotropic, low loss chiral material 40 described by Eqs. (1) and (2). As used herein, the term "thick" means that the radius of the substrate is much larger than the operating wavelength of the antenna. The cylindrical coordinates $\rho$, $\phi$, and z are used wherein the z axis is along the axis of the antenna element 30 and $\rho$ and $\phi$ are in the plane perpendicular to the antenna element 30. The electric current source for the antenna element 30 can be expressed as;

$$J = I_0\delta(x)\delta(y)e^{-i\omega t}e_z \tag{6}$$

where $e_z$ is the unit vector along the z axis, and $\delta$ is the Dirac delta function. In the presence of this electric line source, the solutions of Eqs. (3) and (4) subject to the boundary conditions at y=0 are obtained. In the upper half space 35, the far-zone electric field has, in general, two components, $E_\phi$ and $E_z$. These two components are expressed as $$E_\phi = \frac{-iI}{\sqrt{2\pi k_0\rho}} \exp\left(ik_0\rho - i\frac{\pi}{4}\right)\times k_0\sin\phi\,\frac{1}{\eta_c}\left(\frac{\sqrt{k_-^2 - k_0^2\cos^2\phi}}{k_-} - \frac{\sqrt{k_-^2 - k_0^2\cos^2\phi}}{k_+}\right)\div \left\{\frac{2}{\eta_c}\left[\frac{1}{\eta_0}\,\frac{\sqrt{k_-^2 - k_0^2\cos^2\phi}\,\sqrt{k_-^2 - k_0^2\cos^2\phi}}{k_+k_-} + \frac{\sin^2\phi}{\eta_0}\right] + \sin\phi\left[\frac{\sqrt{k_+^2 - k_0^2\cos^2\phi}}{k_+} + \frac{\sqrt{k_-^2 - k_0^2\cos^2\phi}}{k_-}\right]\left(\frac{1}{\eta_0^2} + \frac{1}{\eta_c^2}\right)\right\} \tag{7}$$

and $$E_z = \frac{-I}{\sqrt{2\pi k_0\rho}} \exp\left(ik_0\rho - i\frac{\pi}{4}\right)\times k_0\sin\phi\left[\frac{2\sin\phi}{\eta_c} + \frac{1}{\eta_0}\left(\frac{\sqrt{k_-^2 - k_0^2\cos^2\phi}}{k_-} - \frac{\sqrt{k_+^2 - k_0^2\cos^2\phi}}{k_+}\right)\right]\div \left\{\frac{2}{\eta_c}\left[\frac{1}{\eta_0}\,\frac{\sqrt{k_+^2 - k_0^2\cos^2\phi}\,\sqrt{k_-^2 - k_0^2\cos^2\phi}}{k_+k_-} + \right.\right. \tag{8}$$

-continued $$\left.\left.\frac{\sin^2\phi}{\eta_0}\right] + \sin\phi\left[\frac{\sqrt{k_+^2 - k_0^2\cos^2\phi}}{k_+} + \frac{\sqrt{k_-^2 - k_0^2\cos^2\phi}}{k_-}\right]\left(\frac{1}{\eta_0^2} + \frac{1}{\eta_c^2}\right)\right\}$$

where $$\eta_0 = \sqrt{\mu_0/\epsilon_0}\ , \quad \eta_c = \frac{\sqrt{\mu/\epsilon}}{\sqrt{1 + \xi_c^2\mu/\epsilon}}\ ,$$

and the other parameters have been previously defined.

In the chiral substrate 40, it is more convenient to express the electric field in terms of two chiral eigenmodes of propagation, $E_{RCP}$ and $E_{LCP}$. Thus the far-zone electric field in the chiral half space 45 can be written as a superposition of the two following eigenmodes:

$$E_{RCP} = \frac{1}{\sqrt{2\pi k_+\rho}} \exp\left(ik_+\rho - i\frac{\pi}{4}\right)\times k_+\sin\phi\left(\frac{1}{\eta_0}\,\frac{\sqrt{k_-^2 - k_+^2\cos^2\phi}}{k_-} + \frac{1}{\eta_c}\,\frac{\sqrt{k_0^2 - k_+^2\cos^2\phi}}{k_0}\right)\div \left\{\frac{2}{\eta_c}\left[\frac{1}{\eta_0}\,\frac{k_0^2 - k_+^2\cos^2\phi}{k_0^2} - \frac{\sin\phi}{\eta_0}\,\frac{\sqrt{k_-^2 - k_+^2\cos^2\phi}}{k_-}\right] + \frac{\sqrt{k_0^2 - k_+^2\cos^2\phi}}{k_0}\left[-\sin\phi + \frac{\sqrt{k_-^2 - k_+^2\cos^2\phi}}{k_-}\right]\left(\frac{1}{\eta_0^2} + \frac{1}{\eta_c^2}\right)\right\} \tag{9}$$

and $$E_{LCP} = \frac{1}{\sqrt{2\pi k_-\rho}} \exp\left(ik_-\rho - i\frac{\pi}{4}\right)\times k_-\sin\phi\left(\frac{1}{\eta_0}\,\frac{\sqrt{k_+^2 - k_-^2\cos^2\phi}}{k_+} + \frac{1}{\eta_c}\,\frac{\sqrt{k_0^2 - k_-^2\cos^2\phi}}{k_0}\right)\div \tag{10}$$

-continued $$\left\{ \frac{2}{\eta_c} \left[ \frac{1}{\eta_0} \frac{k_0^2 - k_-^2\cos^2\phi}{k_0^2} - \frac{\sin\phi}{\eta_0} \frac{\sqrt{k_+^2 - k_-^2\cos^2\phi}}{k_+} \right] + \frac{\sqrt{k_0^2 - k_-^2\cos^2\phi}}{k_0} \left[ -\sin\phi + \frac{\sqrt{k_+^2 - k_-^2\cos^2\phi}}{k_+} \right] \left( \frac{1}{\eta_0^2} + \frac{1}{\eta_c^2} \right) \right\}$$

where $E_{RCP}$ and $E_{LCP}$ are the amplitudes of right- and left-circularly polarized waves inside the chiral material 40. FIGS. 3A–3D present the plots of the radiated power of $E_\phi$, $E_z$, $E_{RCP}$ and $E_{LCP}$ for the chirostrip antenna shown in FIG. 2.

Figure 3A:
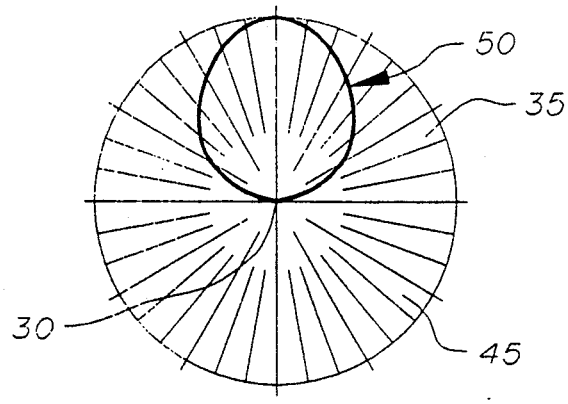
FIGS. 3A–3D present the plots of power associated with electric field components in the upper and lower half spaces of the embodiment shown in FIG. 2 for $\epsilon=9\epsilon_0$, $\mu=\mu_0$, and $\xi_c=0.001$ mho. These plots are not drawn in scale. Each plot is normalized with respect to its own maximum.
Figure 3B:
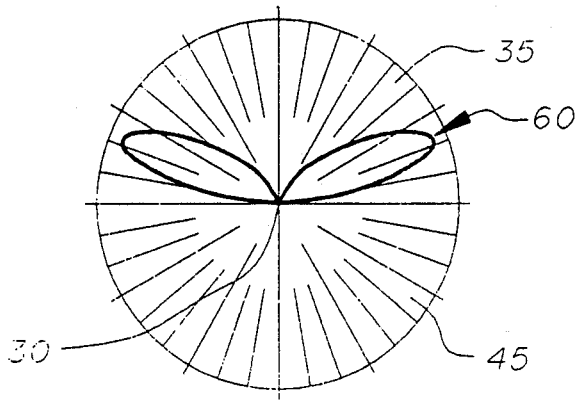
Figure 3C:
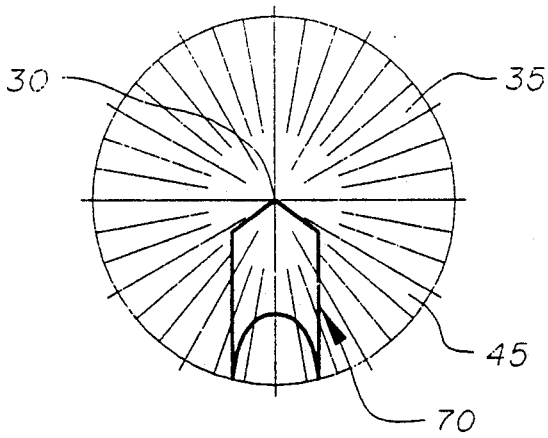
Figure 3D:
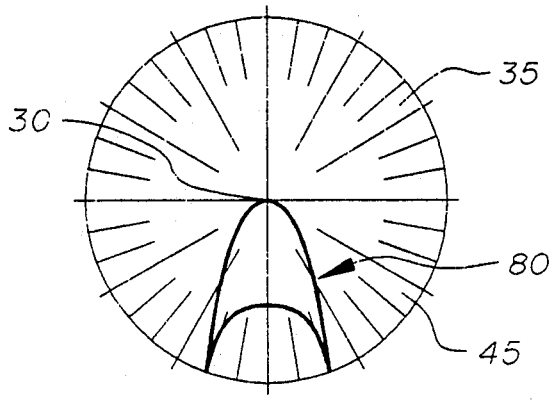

The upper half space 35, and lower half space 45, and antenna element 30 are shown in each of the plots. It is noted that, although the antenna element 30 is a long wire in the z direction, in the upper region of the structure 35, there are two components of the electric field, i.e., $E_z$ 50 (FIG. 3A) and $E_\phi$60 (FIG. 3B). The relative value of $E_\phi$ over $E_z$ depends on the chirality parameter of the chiral substrate. If conventional non-chiral materials are used as substrate for this embodiment, $E_\phi$ will vanish. This allows for existence of multipolarized radiation patterns using a simple wire antenna element. $E_{RCP}$70 and $E_{LCP}$80 are also shown in FIGS. 3C & 3D, respectively. The difference in the directions of maxima of these two radiation patterns depends on the chirality of the substrate.

Another important feature of chirostrip antennas is the possibility of reducing surface-wave propagation inside the slab chiral substrate and any desired superstrate structure. Loss of electromagnetic energy in conventional non-chiral layers used in present printed-circuit antennas is a constraint in the design of such antennas. In addition, generation of surface waves in conventional dielectric substrates and superstrates in these conventional printed-circuit antennas is an undesirable phenomenon which degrades the performance of such devices. In fact, the presence of surface waves decrease the radiation efficiency of printed-circuit antennas, generate unwanted sidelobes, and reduce the bandwidth of these antennas. A long-felt need in the art therefore exists for printed-circuit antennas which do not have the aforementioned undesirable characteristics. Printed-circuit antennas provided in accordance with this invention satisfy this long-felt need. In chirostrip antennas provided in accordance with this invention, however, due to the fact that in a chiral material the eigenmodes of propagation are left- and right-circularly polarized waves with unequal phase velocities, a linearly polarized electromagnetic wave traversing such a material would have its plane of polarization rotated. Depending upon the particular desired design parameters of printed-circuit antennas provided in accordance with this invention, the chiral substrate may be adapted to reduce surface-wave energy. This leads to higher radiation efficiencies and bandwidths.

There are several embodiments provided in accordance with this invention. While preferred embodiments have been disclosed and described, it will be recognized by those with skill in the art that modifications are within the true spirit and scope of the invention. The appended claims are intended to cover all such modification.

What is claimed is:

1. A printed-circuit antenna adapted to receive and transmit electromagnetic energy comprising:

a semicylindrical substrate layer having a top planar surface and a bottom curved surface, the semicylindrical substrate layer further comprising a thick, isotropic, homogeneous, low loss bounded chiral material adapted to cause electromagnetic energy incident to the top planar surface of the semicylindrical substrate layer to propagate according to two eigenmodes having different wavenumbers within the semicylindrical substrate, wherein said semicylindrical substrate layer is further adapted to modify surfacewave energy by rotating the electromagnetic energy's plane of polarization; and a conducting printed wire element interfaced to the top planar surface of the semicylindrical substrate and adapted to conduct the electromagnetic energy to the top planar surface of the semicylindrical substrate.

2. A printed-circuit antenna adapted to receive and transmit electromagnetic energy comprising:

a slab substrate layer having a top and a bottom surface, the slab substrate layer further comprising an isotropic, homogeneous, low loss bounded chiral material adapted to cause electromagnetic energy incident to the top surface of the slab substrate layer to propagate according to two eigenmodes having different wave numbers within the slab substrate, said slab substrate being further adapted to modify surface-wave energy by rotating the electromagnetic energy's plane of polarization;

a ground plane comprised of an electromagnetically conductive material interfaced with the bottom surface of the slab substrate layer; and at least one printed antenna element interfaced to the top surface of said slab substrate layer and adapted to conduct the electromagnetic energy to the top surface of the slab substrate.

3. A printed-circuit antenna adapted to receive and transmit electromagnetic energy comprising:

a semicylindrical substrate layer having a top planar surface and a bottom curved surface, the semicylindrical substrate layer further comprising a thick, isotropic, homogeneous, low loss bounded chiral material adapted to cause electromagnetic energy incident to the top planar surface of the semicylindrical substrate layer to propagate according to two eigenmodes having different wavenumbers within the semicylindrical substrate, said semicylindrical substrate layer being further adapted to modify surface-wave energy by rotating the electromagnetic energy's plane of polarization; and a conducting printed antenna element interfaced to the top planar surface of the semicylindrical substrate and adapted to conduct electromagnetic energy to the top planar surface of the semicylindrical substrate.

* * * * *